US006086332A

United States Patent [19]

Barker

[11] Patent Number: 6,086,332

[45] Date of Patent: Jul. 11, 2000

[54] VANE PUMP ASSEMBLY

[76] Inventor: Donald E. Barker, 8 Mountain Laurel La., Sandy Hook, Conn. 06482

[21] Appl. No.: 09/158,654

[22] Filed: Sep. 22, 1998

[51] Int. Cl.[7] ..... F04B 19/24

[52] U.S. Cl. ..... 417/53; 417/238

[58] Field of Search ..... 417/53, 238, 310, 417/423; 418/15, 26, 30; 297/452.41

[56] References Cited

U.S. PATENT DOCUMENTS

| | | | |
|---|---|---|---|
| 4,286,933 | 9/1981 | Sakamaki et al. | 418/15 |
| 4,352,641 | 10/1982 | Tuckey | 417/283 |
| 4,401,416 | 8/1983 | Tuckey | 417/283 |
| 5,100,308 | 3/1992 | Gevelhoff et al. | 418/30 |
| 5,141,418 | 8/1992 | Ohtaki et al. | 418/26 |
| 5,152,579 | 10/1992 | Bishai . | |
| 5,797,731 | 8/1998 | Kobayashi et al. | 417/238 |
| 5,823,752 | 10/1998 | Hoenisch et al. | 417/363 |

*Primary Examiner*—Teresa Walberg
*Assistant Examiner*—Jeffrey Pwu
*Attorney, Agent, or Firm*—Pitts & Brittian, P.C.

[57] ABSTRACT

A vane pump assembly which uses a biasing means for regulating the internal and maximal output pressure of the vane pump rather than the maximal output of the pump motor. The pump assembly includes a motor having an output drive shaft, a housing having a front end and a rear end seated on the motor, a cylindrical member received Within the housing, first and second closure members which overlie the respective front and rear ends of the cylindrical member, a cylindrical hub eccentrically received on the drive shaft within the cylindrical member, a plurality of vanes disposed about the cylindrical hub, a cap member covering the front end of the pump housing, and a resilient means disposed between the motor and the second closure member for selectively biasing the cylindrical member between the first and second closure members and enabling the pump to develop a preselected maximum output therefrom without halting rotation of the cylindrical hub. The biasing means is interchangeable to provide variable maximal degrees of output pressure. The pump assembly is integrable into a seat support system.

21 Claims, 6 Drawing Sheets

VANE PUMP ASSEMBLY

This application in part discloses and claims subject matter disclosed in my earlier filed pending application, Ser. No. 08/858,521, filed on May 19, 1997.

TECHNICAL FIELD

This invention relates to the field of pumps and pump assemblies. More specifically, this invention relates to a vane pump assembly whose maximum output is regulated by a biasing means which provides a desired biasing force rather than by the maximum output of a preselected motor.

BACKGROUND ART

It is well known that the effectiveness of a pump assembly is measured by the quality of its construction and its efficiency. The size of the assembly and its power with relation to its size are even more important where the assembly is disposed within confined area such as the back or base of a chair or seat.

Other vane pump assemblies have been produced for providing fluid to and from fluid receptacles. Among the assemblies in the art are those whose construction includes a pump housing, a pump motor disposed on one end of the pump housing and a cover positioned on the opposite end of the housing. Typically, such pumps further include a housing liner capsule positioned within the housing, a composite assembly disposed within the liner capsule, a stem which extends from the motor to receive and rotatably engage the composite assembly, and a housing cover. The housing is positioned on the motor about the stem. The composite assembly typically includes a hub having a centrally disposed pore for being positioned on the stem and a plurality of vanes which are evenly spaced and movably received in the hub. The pump housing cover typically includes an intake port and an outlet port. In operation, an electrical current causes the motor to rotate the stem and the composite assembly. As the composite assembly rotates each vane is variably extended from within the hub. The variable movement of the vanes in the hub create a force which draws fluid into the liner capsule through the intake port and urges that fluid out the outlet port and into the fluid receptacle.

Pump devices in the art require precision assembly to insure their effective operation. The pump housing cover is seated on the pump housing using mounting screws. When the mounting screws are not properly seated in the pump housing, the housing cover fails to seat properly on the pump housing and the composite assembly fails to generate air pressure sufficient to fill the fluid receptacle as quickly or completely as desired. Consequently, the need for precision assembly of pumps in the art increases the potential for malfunction due to mis-seating the housing cover. Moreover, the need for precision assembly adds to the overall costs of these pumps as each unit must be end-line tested to insure its operation. Each unit found to be malfunctioning as a result of this inspection must be repaired or rebuilt, as necessary.

Pump devices in the art are known to generate a high degree of heat during their operation due to the function of the motor and the high speed of rotation of the composite assembly in the pump housing. The heat generated by these pumps is even greater where they include a conventional motor which is designed to stall once it attains a maximum pre-selected pressure. The pump housing of pump assemblies in the art is typically fabricated from plastic to make the pump more lightweight and economical to produce. The high heat generated by operation of a pump causes expansion of the plastic pump housing. Continued operation of the pump ultimately results in a permanent distortion of the plastic housing and the operational failure of the pump. None of the pump devices in the art are adequately equipped to handle the effects of the high heat generated by their operation. Consequently, the vane pump assemblies of the art are of limited utility.

Pump devices in the art are also use specific. The maximum output of any vane pumping assembly in the art is regulated by the preselection of a motor having a maximum output designed to stall the pump at a preselected maximum pressure. Given this construct, a variation the fluid pressure provided by any pump in the art can only be obtained is by substitution of that pump assembly with another like pump assembly having a motor of another preselected maximum output. The cost to purchase identical pumps of differing maximum outputs, as well as that for the labor and materials for substituting these pumps has heretofore rendered such variations in maximal pump pressure expensive and impractical.

Therefore, it is an object of this invention to provide a vane pump assembly whose maximum output is regulated by a biasing means having a desired biasing force rather than by the maximum output of a preselected motor.

It is also an object of this invention to provide a vane pump having a biasing means which is accessible and interchangeable to accommodate the different pressure needs of the fluid device for which it is utilized.

Another object of this invention is to provide a vane pump assembly which is of compact construction such that it is discretely disposed in select structures, such as the seat back of vehicle seats, and is integrable into the seat support system.

A further object of this invention is to provide a vane pump which reduces the cost of manufacture and the need for repair by eliminating the need to precisely seat the cap member onto the pump housing.

Yet another object of this invention is to provide a vane pump assembly which eliminates pump failure due to over-inflation by permitting leakage of pressurized air from the pump housing when the pressure within the inner housing reaches a selected level.

It is an object of this invention to provide a vane pump which eliminates pump failure by permitting the motor and pump assembly to continue to rotate, and not stall, when a predetermined pressure is reached and excess pressure is vented from the assembly through the pump housing.

Moreover, it is an object of this invention to provide a vane pump assembly which is easily integrated into a seat support system which includes at least one bladder, at least one conduit and a switch for providing comprehensive comfort support to a seat occupant.

DISCLOSURE OF THE INVENTION

Other objects and advantages will be accomplished by the present invention which pumps fluid into a fluid receptacle at a maximal output which is regulated by an interchangeable biasing means rather than the fixed output of a particular pre-selected motor.

The vane pump assembly includes a motor having an output drive shaft extending centrally therefrom, a pump housing having an open rear end seated on the motor and an open front end positioned about the output drive shaft, a cylindrical member received within the pump housing and including an open front end and an open rear end opposite the front end, a first and a second closure member which overlie the front and rear ends of the cylindrical member respectively, a cylindrical hub eccentrically received on the drive shaft within the cylindrical member, a plurality of vanes disposed about the cylindrical hub, a cap member covering the open front end of the pump housing, and a resilient means disposed between the motor and the second closure member for biasing the second closure member into selective sealing relationship with the rear end of the cylindrical member and the front end of the cylindrical member into selective sealing relationship with the first closure member. The biasing means biases the hub and plurality of vanes away from the rear end of the pump housing and avoids the distortion of the housing due to operational heat build-up. Among the resilient means adaptable for use in the vane pump assembly are a Belville washer, a wave washer, a sawtooth washer, a square wave washer, and a cone washer.

In operation, manipulation of a switch activates the motor to create a rotational force that imparts a rotational force on the output drive shaft. The force on the output drive shaft is translated to the cylindrical hub and creates a centrifugal force that radially displaces the plurality of vanes toward the inner wall of the cylindrical member. The movement of the vanes creates a variable pressure gradient which draws ambient fluid into the cylindrical member, compresses the fluid and then exhausts it from the cylindrical member. Where the pressure of the fluid being exhausted from the cylindrical member is too great, the pressure is fed back toward the cylindrical member, as the pump continues to operate, and the resilient means is flexed to create spacing between the cylindrical member and either or both of the closure members to relieve the pressure and avoid damage to the pump assembly.

The vane pump assembly is integrable into a seat support system, such as is provided in vehicle seats, and includes at least one vane pump, at least one fluid receptacle, such as a bladder, and at least one conduit for providing communicating fluid from the vane pump assembly and the bladder such that fluid pressure in the bladder is selectively regulated by operation of the vane pump assembly.

BRIEF DESCRIPTION OF THE DRAWINGS

The above mentioned features of the invention will become more clearly understood from the following detailed description of the invention read together with the drawings in which.

BEST MODE FOR CARRYING OUT THE INVENTION

Figure 1:
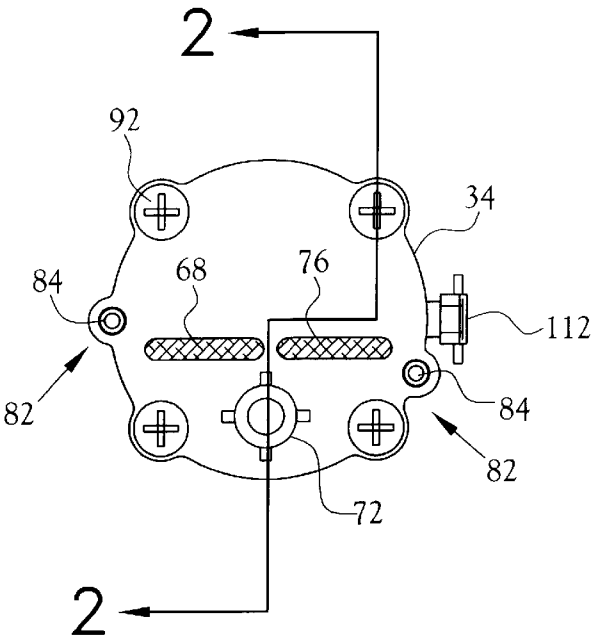
FIG. 1 is an end view of the vane pump assembly constructed in accordance with several features of the present invention.

A vane pump assembly incorporating various features of the present invention is illustrated generally at 10 in the figures. The vane pump assembly 10 provides a maximum output which is regulated by a biasing means 36 having a desired biasing force rather than by a motor having a fixed maximum output. The biasing means 36 also biases the cylindrical hub 22 and the vanes 32 movably disposed in the cylindrical hub 22 away from the pump housing 16 and eliminates the pump failure that typically results when the heat that builds up in the pump housing 16 during operation permanently distorts the pump housing 16. In the preferred embodiment, the vane pump assembly 10 includes a biasing means 36 which is accessible and interchangeable to accommodate the different pressure needs of the fluid device for which it is utilized.

Figure 2:
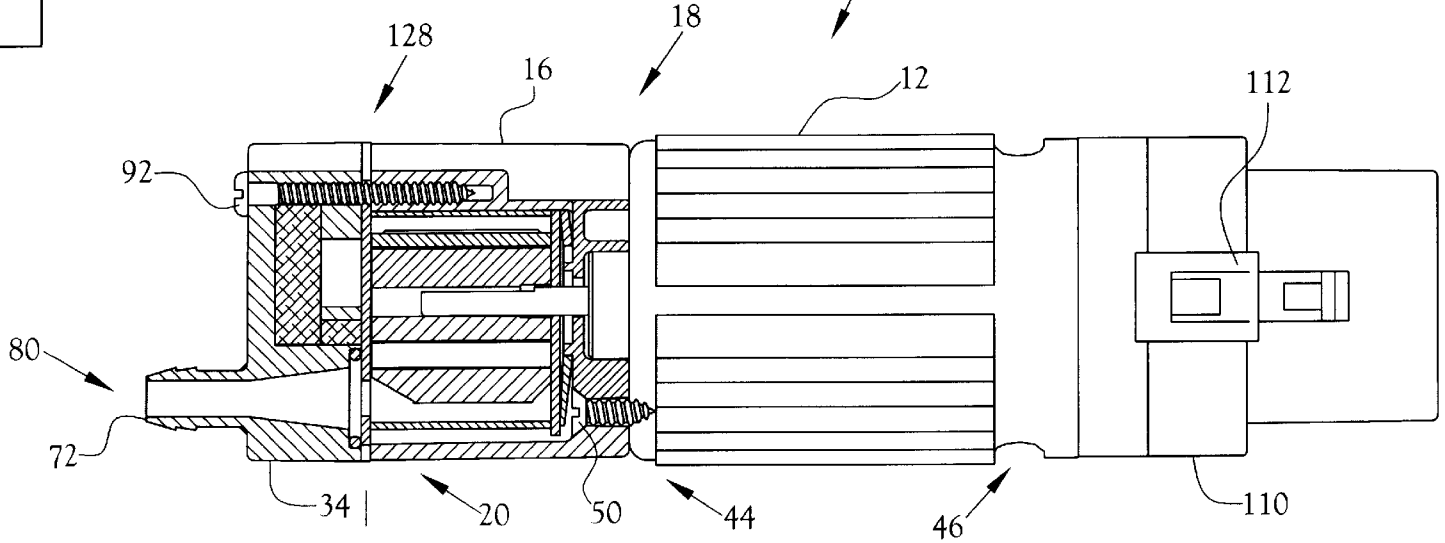
FIG. 2 illustrates a side view of the vane pump assembly, showing the pump housing in section, taken at 2—2 of FIG. 1.

FIG. 1 shows an end view of the vane pump assembly 10 of the present invention. FIG. 2 illustrates a side view of the vane pump assembly, including a sectional view of the pump housing 16, taken at 2—2 of FIG. 1. As shown in FIG. 2, the vane pump assembly of the preferred embodiment further includes a connector 110 disposed on an end 46 of the motor 12 opposite the output drive shaft 14 for providing an electrical connection between the vane pump assembly 10 and a power source. In the preferred embodiment, the vane pump assembly 10 a clip 112 for stabilizing and securing the connection between the pump assembly 10 and the power source. As illustrated in FIG. 1, the clip 112 is positioned on the connector 110. As those skilled in the art will recognize, however, it is preferable to position the clip 112 on the vane pump assembly 10 as is appropriate to optimally stabilize the pump assembly 10.

Figure 3:
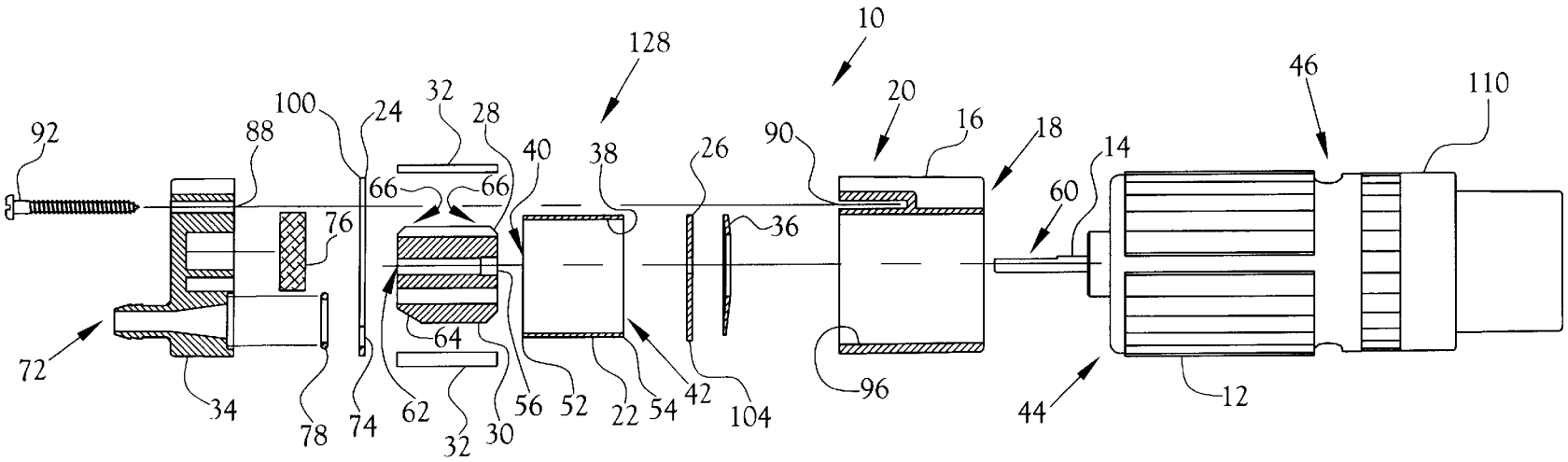
FIG. 3 is an exploded view of the vane pump assembly.

As best shown in FIG. 3, the vane pump assembly 10 includes a motor 12 having an output drive shaft 14, a pump housing 16 having an open rear end 18 adjacent the motor 12 and an open front end 20 positioned about the output drive shaft 14, a cylindrical member 22 received within the pump housing 16 and including an inner circumferential wall 38, an open front end 40 including a circumferential rim 52 and an open rear end 42 including a circumferential rim 54 opposite the front end 40, a first and a second closure member 24, 26 which overlie the front and rear ends 40, 42 of the cylindrical member 22 respectively, a cylindrical hub 28 having an outer circumference 30 disposed within the cylindrical member 22 and eccentrically received on the output drive shaft 14, a plurality of vanes 32 disposed about the outer circumference 30 of the cylindrical hub 28, a cap member 34 covering the open front end 20 of the pump housing 16 and capturing the cylindrical member 22 within the pump housing 16, and a resilient means 36 disposed between the motor 14 and the second closure member 26 overlying the rear end 42 of the cylindrical member 22 for providing a biasing force which urges the second closure member 26 into selective sealing relationship with the circumferential rim 54 of the rear end 42 of the cylindrical member 22 and the circumferential rim 52 of the front end 40 of the cylindrical member 22 into selective sealing relationship with the first closure member 24.

As shown in FIG. 3, the output drive shaft 14 extends centrally from one end 44 of the motor 12, the cylindrical member 22 and the second closure member 26 are separate elements, and the rear end of the pump housing is open and seated on the motor 12. In the preferred embodiment illustrated in FIG. 4, the output drive shaft defines a key configuration 60, the second closure member 26 and the resilient means 36 are integrally formed to define a cup, and the rear end 18 of the pump housing 16 further defines a rear end wall 48 such that the resilient means 36 is disposed between the rear end wall 48 of the pump housing 16 and the second closure member 26 overlying the rear end 42 of the cylindrical member 22. Two mounting screws 50 are utilized to secure the pump housing 16 to the motor 12.

The cup configuration is advantageous as it reduces the cost of manufacture and assembly of the vane pump assembly 10 without altering its efficiency. Other methods of fabricating these element of the vane pump assembly are equally foreseeable. In another configuration, for example, the second closure member 26 having the resilience properties of the resilient means 36 such that only the resilience of the assembly 10 is provided without the resilient means 36. Other pump housing configurations and methods for securing the pump housing to the motor are also foreseeable.

Figure 4:
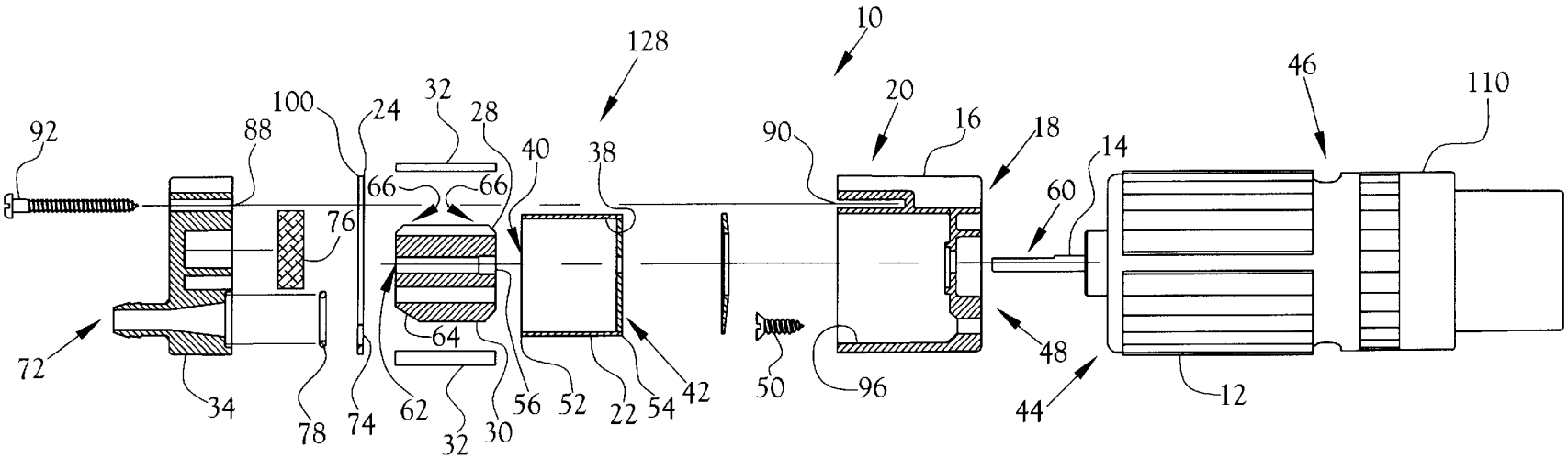
FIG. 4 is an exploded view of the preferred embodiment of the vane pump assembly.
Figure 5:
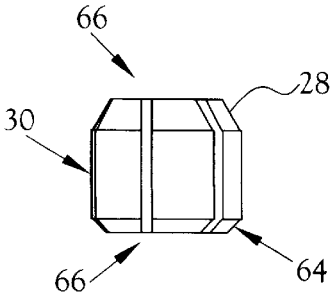
FIG. 5 is a side view of the drive hub of the vane pump assembly.

The cylindrical hub 28 includes a central through-opening 56 for being positioned about the output drive shaft 14 and a plurality of vane openings 58 for receiving a plurality of vanes 32. In the preferred embodiment shown in FIG. 4, the cylindrical hub through-opening 82 defines a key configuration 62 corresponding to that of the output drive shaft 14. The coordinated configuration of the output drive shaft 14 and the cylindrical hub through-opening 56 enables the snug fit of the cylindrical hub 28 about the drive shaft 14 and insures their coordinated rotation. As illustrated in FIGS. 4 and 5, the cylindrical hub 28 of the preferred embodiment further includes a beveled edge 64 at opposed ends 66, 68 to enhance fluid flow into and from the cylindrical member 22 out of the vane pump assembly 10.

Figure 6:
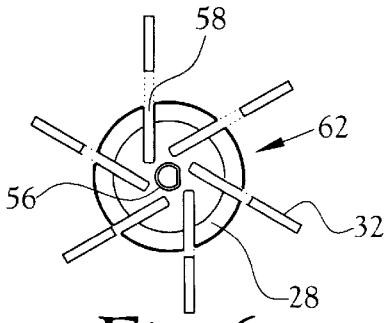
FIG. 6 is an exploded view of the drive hub and the vanes of the vane pump assembly.
Figure 7:
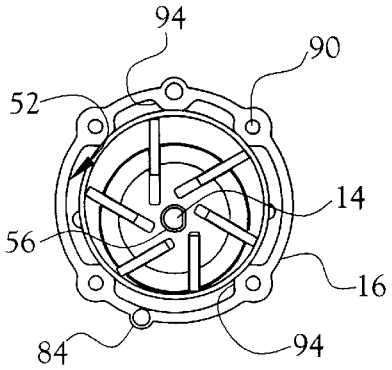
FIG. 7 illustrates an end view of the vane pump assembly with the housing cover and top plate removed.

FIG. 6 depicts the plurality of vane openings 58 disposed about the outer circumference 30 of the cylindrical hub 28 and one each of the plurality of vanes 32 received in each vane opening 58. As best seen in FIG. 7, the plurality of vanes 32 are radially displaced toward the inner wall 38 of the cylindrical member 22 on rotation of the cylindrical hub 28. This movement of the vanes 28 creates a pressure gradient which draws ambient fluid into the cylindrical member 22, compresses and then exhausts it out of the cylindrical member 22. As those skilled in the art will recognize, the vane pump assembly 10 can be fabricated to include a variable number of vane openings 58 in the cylindrical hub 28 and vanes 32 in those vane openings 58. In the preferred embodiment shown in FIGS. 6 and 7, the cylindrical hub 28 includes six equidistantly and equiangularly disposed vane openings 58 and six vanes 32 received in those openings.

As illustrated in FIGS. 3 and 4, the cap member 34 and the first closure member 24 include first respective openings 68, 70 for permitting the flow of ambient fluid therethrough into the cylindrical member 22 and second respective openings 72, 74 for exhausting compressed fluid therethrough from the cylindrical member 22 to a location outside the cap member 34. In the preferred embodiment, the cap member 34 further includes a filter 76 disposed between the first respective openings 68, 70 to screen fluid borne particulate from the ambient fluid being drawn into cylindrical member 22 and an o-ring 78 disposed between the second respective openings 72, 74 to create a uniform channel 80 for exhausting the compressed fluid from the cylindrical member 22. As shown in FIG. 1, the cap member 34 of the preferred embodiment includes a pair of first openings 68, 70 and the filter 76 positioned within cap member 34 to effectively screen both of these inlets.

The pump housing 16 and the cap member 34 of the preferred embodiment define at least one registration device 82 for aligning the cap member 34 to the pump housing 16, as shown in FIG. 1. The registration device 82 includes a post 84 carried by one of the pump housing 16 and the cap member 34 and a post receptor 86 carried by the other of the pump housing 16 and the cap member 34. While any number of posts 84 and post receptors 86 can be utilized to align the pump housing 16 and the cap member 34, as illustrated in FIG. 7, the vane pump assembly 10 of the preferred embodiment includes two posts 84 disposed on the pump housing 16 and two post receptors 86 coordinately positioned on the cap member 34.

The pump housing 16 and the cap member 34 of the preferred embodiment, as shown in FIGS. 3 and 4, also include a plurality of securement devices 128 for securing the cap member 34 to the pump housing 16. Each securement device 128 includes a securement screw 92, a screw boss 90 for removably receiving a securement screw 92 and a securement screw opening 88 for permitting the passage of and captured by the securement screw 92 as the screw 92 is received in the screw boss 90 such that the cap member 34 is securely seated on the pump housing 16. The vane pump assembly 10 is configurable such that one of the securement screw boss 90 and the securement screw opening 88 is positioned on the cap member 34 and the other of the securement screw opening 88 and the securement screw boss 90 is positioned on the pump housing 16. In the preferred embodiment, the cap member 34 includes four securement screw openings 88 and the pump housing 16 includes four securement screw bosses 90.

As illustrated in FIG. 7, in the preferred embodiment each screw boss 90 and each registration device 82 on the pump housing 16 extends along an inner circumference 96 of the pump housing 16 to define a rib 94 for enhancing the fit of the cylindrical member 22 within the pump housing 16. The securement devices 128 and registration devices 82 of the preferred embodiment enhance the adaptability of the pump assembly 10 for different support uses as the securement screws 92 facilitate access to the pump housing 16 for interchanging resilient means 36 of different tolerances and re-attaching and securing the cap member to the pump housing 16 thereafter.

Figure 8:
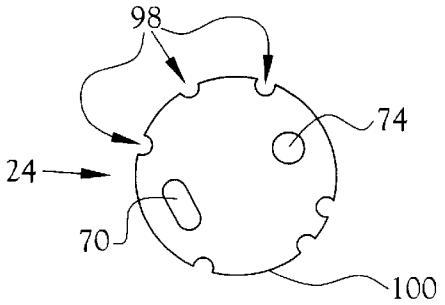
FIG. 8 depicts a top view of the first closure member of the vane pump assembly.
Figure 9:
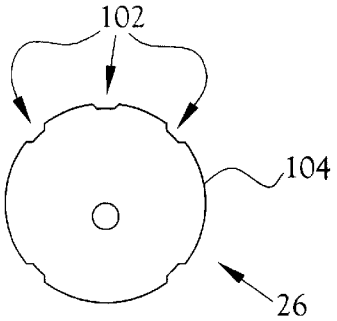
FIG. 9 is a top view of the second closure member of the vane pump assembly.

In the preferred embodiment shown in FIG. 8, the first closure member 24 further includes a plurality of notches 98 disposed about its periphery 100 to align the first closure member 24 with the posts 84 defined by the registration devices 82 on the pump housing 16. As illustrated in FIG. 9, the second closure member 26 also includes a plurality of notches 102 disposed about its periphery 104 to align the second closure 26 member with the ribs 94 extending along the inner circumference 96 of the pump housing 16. The notches 98, 102 on first and second closure members 24, 26 enhance the fit of closure members 24, 26 in the pump housing 16 and the structural integrity of the vane pump assembly 10.

Appreciating the securement devices 128 preferably employed in the pump assembly 10 of the present invention, those skilled in the art will recognize as foreseeable an embodiment of the pump assembly 10 wherein the cap member 34 includes a plurality of securement screw openings 88, the motor 14 defines a plurality of screw bosses 90, and the plurality of securement screws 92 disposed between the screw openings 88 and the screw bosses 90 define a cage for encapsulating the other elements of the vane pump assembly 10 such that the pump housing 16 is unnecessary. The pump housing 16 described herein is preferred, nonetheless, as it provides a more effective manner of insulating the elements of the pump assembly 10 from interference from outside elements. Other securement devices 128, registration devices 82 and embodiments of the present invention utilizing these devices 128, 82 are equally foreseeable.

Figure 10:
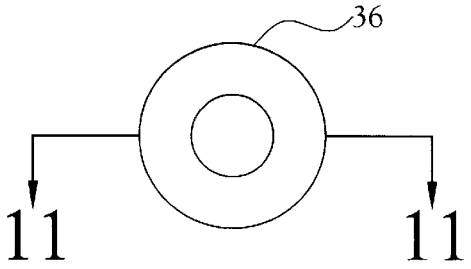
FIG. 10 illustrates a top view of the preferred embodiment of the biasing means of the vane pump assembly.
Figure 11:
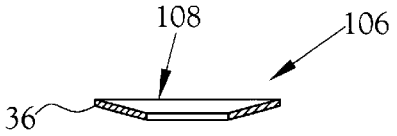
FIG. 11 is a side view of the biasing means of FIG. 10, taken at 11—11 of FIG. 10.
Figure 12:
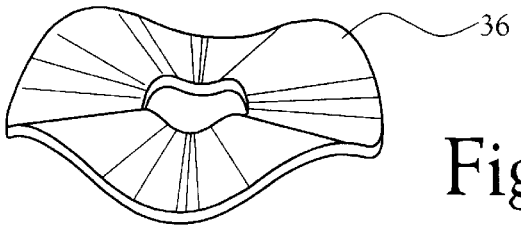
FIG. 12 is a perspective view of one embodiment of a biasing means having a periodic shape.
Figure 13:
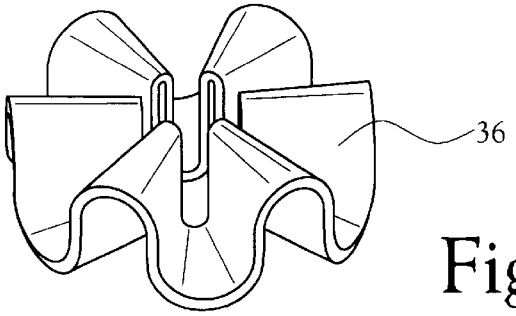
FIG. 13 illustrates a perspective view of a second embodiment of a biasing means having a periodic shape.
Figure 14:
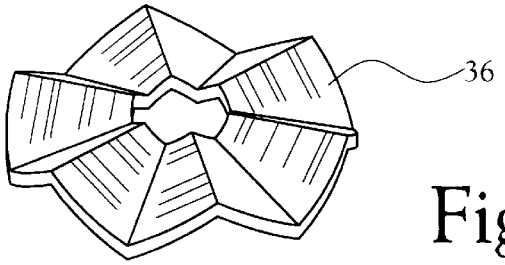
FIG. 14 shows a perspective view of a third embodiment of a biasing means having a periodic shape.
Figure 15:
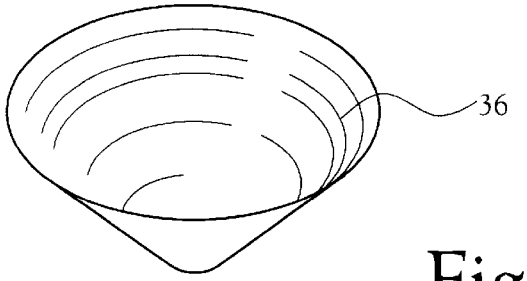
FIG. 15 shows a perspective view of a fourth embodiment of a biasing means having a periodic shape.

The resilient means 36 of the present invention is adaptable to diverse configurations. One such resilient means 36 is the Belleville washer 106 illustrated in FIGS. 10 and 11. The Belville washer 106 is arcuately configured to define a concave surface 108 and is positionable in the pump housing 16 such that its concave surface 108 faces toward the second closure member 26. Other adaptable resilient means 36 define a periodic shape, such as a wave, a sawtooth washer, or a cone washer, as exemplified in FIGS. 12–15, respectively. Comparative testing of a wave washer, a cone washer and a Belville washer, using four motors producing four different levels of static pressure, generated average pressure values ranging from 1.95 to 4.75 psi, respectively. Accordingly, the resilient means 36 of the preferred embodiment is the Belleville washer. It will be recognized nonetheless that a variable number of different types of resilient means 36 are interchangeable into the vane pump assembly 10. It will also be recognized that the utility of still other resilient means 36, such as a conventional coil spring, for example, are equally foreseeable. Moreover it will be recognized that the diameter of a selected resilient means may be varied just as its shape to produce the desired biasing pressure.

The Belleville washer 106 is fabricated from steel having differing tolerances to provide the vane pump 10 with different fluid pumping strengths. The differing tolerances of the Belleville washers 106 enable the selective customizing of vane pump assembly 10 depending on where the pump assembly 10 is disposed and the type of support sought. Once these factors are determined, the securement screws 92 of the pump assembly 10 are loosened and a Belleville washer 106 of one flexion tolerance is selectively substituted into the pump assembly 10 for a washer 106 of another flexion tolerance and the desired fluid pressure may be obtained. As those skilled in the art will recognize, a Belleville washer 106 having a higher flexion tolerance, or greater psi capacity, is insertable into the pump assembly 10 where greater pressure or support firmness is desired. Similarly, a Belleville washer 106 of a lower flexion tolerance, or lesser psi capacity, is insertable into the pump assembly 10 where lesser pressure or support firmness is needed.

Figure 16:
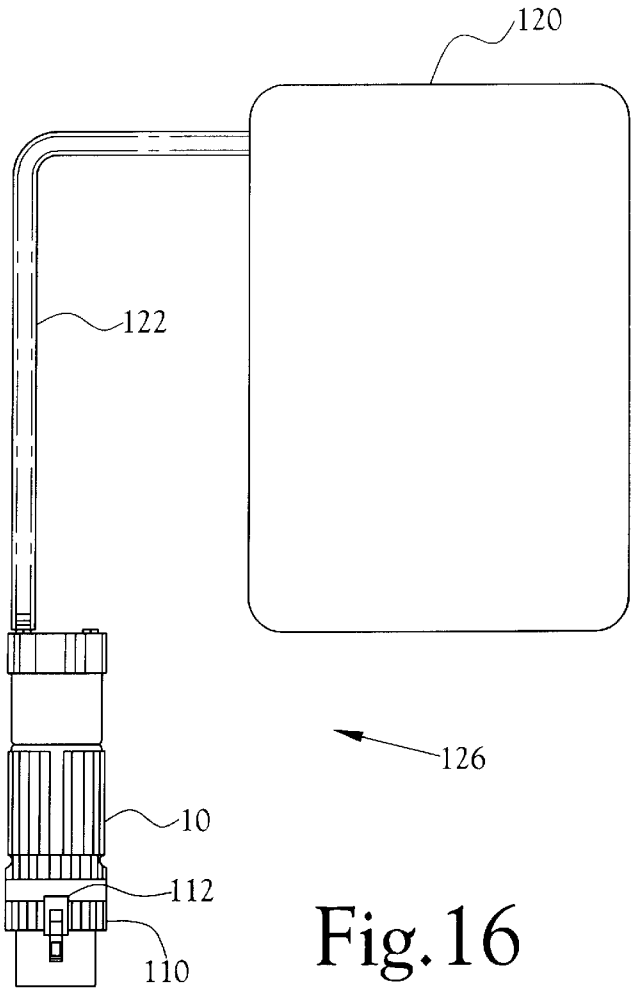
FIG. 16 illustrates an embodiment of a seat support system incorporating the vane pump assembly of the present invention, a bladder and a conduit for providing fluid communication therebetween.

The vane pump assembly 10 is integrable into a simple seat support system 116 such as is illustrated in FIG. 16. The seat support system 116 includes at least one vane pump 118, at least one fluid receptacle 120, such as a bladder, and at least one conduit 122 for providing fluid communication between the vane pump 118 and the bladder 120 such that fluid pressure in the bladder 120 is selectively increased and decreased by manipulation of the vane pump 118.

Figure 17:
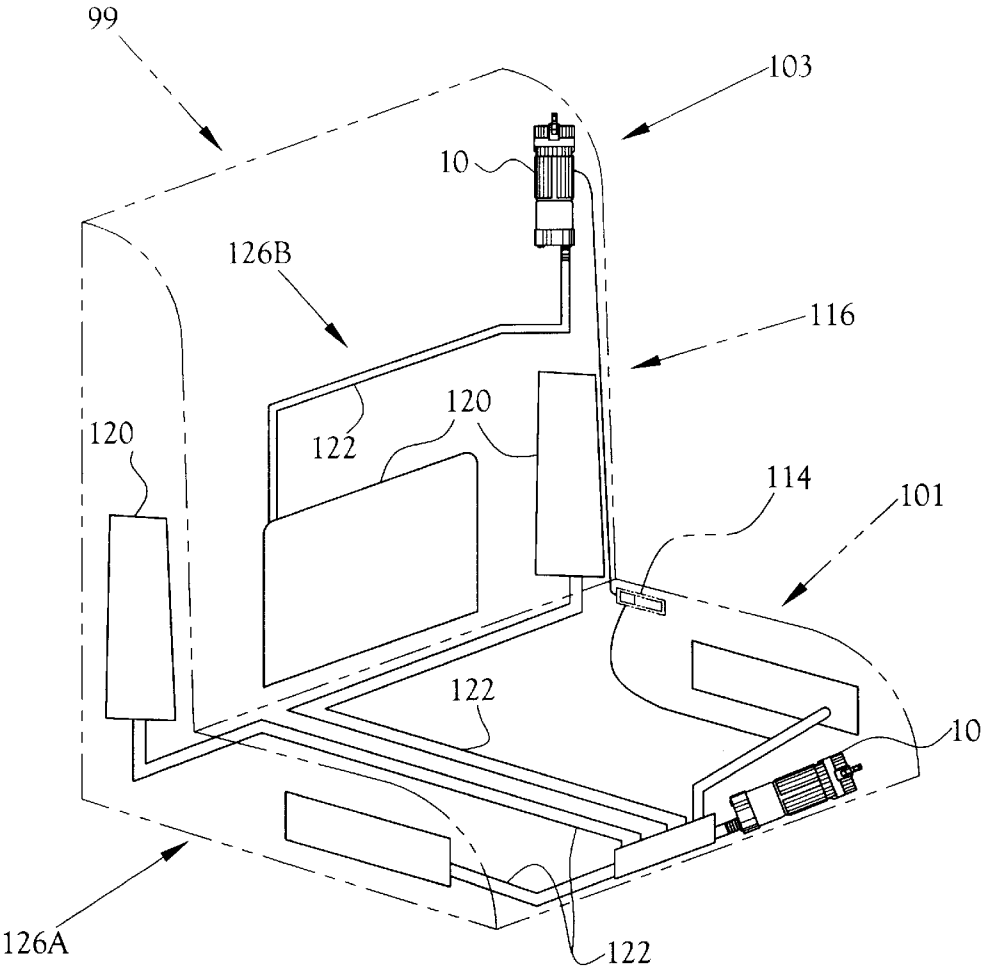
FIG. 17 illustrates another embodiment of a seat support system which employs the support system shown in FIG. 15 in combination with another configuration of the vane pump assembly of the present invention interconnected by a plurality of conduits with a plurality of fluid receptacles.

As shown in FIG. 17, in the preferred embodiment, the seat support system 116 includes a plurality of vane pumps 118 connected to a plurality of bladders 120 by a plurality of conduits 122, with each pump 118 having a biasing means 36 of a differing flexion tolerance for providing varying types of support in different portions of the seat 109. In the illustrated system, a vane pump-conduit-bladder combination 126A disposed in the seat base 101 and seat back 103 of a seat 99 provides bi-lateral leg and bi-lateral torso support. Another vane pump-conduit-bladder combination 126B disposed in the seat back 103 provides selective lower lumbar support to the lumbar area.

Operation of each combination 126A, 126B of the system 116 is variably regulable by operation of at least one switch 114 which is also disposed in the seat 99. In one embodiment, the switch 114 is a solenoid and fluid cell combination in which the solenoid 114 activates the motor and the fluid cell permits the active release of fluid from the fluid receptacle by use of the motor 12 or the passive release of fluid by bleeding it out of the receptacle through the air cell. In another embodiment, the switch 114 is electro-pneumatic and functions in a dual capacity to actively or passively release the fluid from the fluid receptacle like the solenoid and air cell combination described above. Other switches 114 of similar capacity are equally foreseeable.

In operation, manipulation of the switch 114 activates the motor 12 of each pump assembly 10 to create a rotational force. The rotational force of each motor 12 imparts a rotational force on each output drive shaft 14. The force on the drive shaft 14 is translated to each cylindrical hub 28 and creates a centrifugal force that radially displaces the plurality of vanes 32 from their respective vane openings 58 and toward the inner circumferential wall 38 of each cylindrical member 22. The movement of the vanes 86 within their vane openings 58 and the rotation of the cylindrical hub 22 cooperate to create a variable pressure gradient such that ambient fluid is drawn into each cylindrical member 22, compressed and exhausted from the cylindrical member 22 into each of the bladders 120 of each combination 1226A, B through their respective conduits 122. Where the fluid pressure in the bladders 122 is too great, the pressure feeds back toward the cylindrical members 22 of the assemblies 10 and the resilient means 36 are flexed to create spacing between those member 22 and either or both of their respective closure members 24, 26 and to relieve the fluid pressure and thereby avoid damaging the pump assemblies 10. The illustrated system 116 is but one example of effective and powerful occupant seat support systems which are possible given the vane pump assembly 10 of the present invention and the interchangability of the biasing means 36 according to particularized needs for occupant seat support. Other combinations of such a seat support system are equally foreseeable.

From the foregoing description, it will be recognized by those skilled in the art that a vane pump assembly offering advantages over the prior art has been provided. The vane pump assembly achieves a maximum output which is regulated by a biasing means having a desired biasing force and/or diameter rather than by pre-selection of a motor having a fixed maximum output. The motor and pump assembly of the vane pump never stall when that maximum output is attained. The biasing means of the vane pump assembly is accessible and interchangeable to accommodate the different pressure needs of the environment in which the pump is used. The vane pump assembly compactly construction such that it may be discretely disposed in select structures, such as the seat back of vehicle. It reduces the cost of manufacture and the need for repair by eliminating the need for precisely seating the cap member onto the pump housing. The assembly eliminates pump failure potential due to heat build-up by rasing the heat producing elements of the pump from the pump housing floor. It eliminates pump failure due to excess fluid pressure by leaking pressurized air from the fluid receptacle, and the pump itself, once a selected pressure level is reached without stalling the motor and pump assembly. It also controls leakage by allowing the preselection of a biasing means of a desired biasing strength and/or diameter. The vane pump assembly is also integrable into a seat support system to provide variable support to a seat occupant through the selective use of biasing means having different degrees of flexion tolerance.

While a preferred embodiment has been shown and described, it will be understood that it is not intended to limit the disclosure, but rather it is intended to cover all modifications and alternate methods falling within the spirit and the scope of the invention as defined in the appended claims.

Having thus described the aforementioned invention,

I claim:

1. A pump assembly comprising:

a motor including an output shaft:

a housing mounted on said motor and receiving said shaft therein; said housing including an open rear end adjacent said motor and an open opposite front end;

a cylindrical member disposed within said housing and including an inner circumferential wall, an open front end including a circumferential rim and an open opposite rear end including a circumferential rim, a first closure member overlying said front end of said cylindrical member, a second closure member overlying said rear end of said cylindrical member;

a cylindrical hub having an outer circumference disposed within said cylindrical member and eccentrically mounted on said output shaft and rotatable therewith;

a plurality of vanes disposed about said outer circumference of said hub, said vanes being radially displaceable with respect to said cylindrical hub and in a direction toward said inner circumferential wall of said cylindrical member upon rotation of said cylindrical hub whereby ambient fluid is drawn into said cylindrical member, compressed and exhausted from said cylindrical member;

a cap member covering said front end of said housing and capturing said cylindrical member within said housing, said cap member and said first closure member including first respective openings therethrough for enabling the flow of ambient fluid into said cylindrical member and second respective openings therethrough for enabling the flow of compressed fluid from said cylindrical member to a location outside said cap member; and resilient means disposed between said rear end of said housing and said second closure member overlying said rear end of said cylindrical member and providing a biasing force which urges said second closure member into a selective sealing relationship of said second closure member with said circumferential rim of said rear end of said cylindrical member, said selective sealing relationship being a function of said biasing force asserted by said resilient means.

2. The pump assembly of claim 1 wherein said biasing force is further transmitted through said cylindrical member to said cap member to establish a selective sealing relationship between said circumferential rim of said front end of said cylindrical member and said cap member, said selective sealing relationship being a function of the biasing force asserted by said resilient means.

3. The pump assembly of claim 2 wherein said resilient means is a Belleville washer.

4. The pump assembly of claim 2 wherein said resilient means is a washer having a plurality of radially oriented flutes.

5. The pump assembly of claim 1 wherein said rear end of said housing defines a rear end wall and said resilient means is disposed between said rear end wall and said second closure member overlying said rear end of said cylindrical member.

6. The pump assembly of claim 5 wherein said biasing force is further transmitted through said cylindrical member to said cap member to establish a selective sealing relationship between said circumferential rim of said front end of said cylindrical member and said cap member, said selective sealing relationship being a function of the biasing force asserted by said resilient means.

7. The pump assembly of claim 6 wherein said resilient means is a Belleville washer.

8. The pump assembly of claim 6 wherein said resilient means is a washer having a plurality of radially oriented flutes.

9. The pump assembly of claim 1 wherein said cylindrical member and said second closure member are integrally formed.

10. The pump assembly of claim 9 wherein said rear end of said housing defines a rear end wall and said resilient means is disposed between said rear end wall and said second closure member integrally formed with said rear end of said cylindrical member.

11. The pump assembly of claim 10 wherein said biasing force is further transmitted through said cylindrical member to said cap member to establish a selective sealing relationship between said circumferential rim of said front end of said cylindrical member and said cap member, said selective sealing relationship being a function of the biasing force asserted by said resilient means.

12. The pump assembly of claim 11 wherein said resilient means is a Belleville washer.

13. The pump assembly of claim 11 wherein said resilient means is a washer having a plurality of radially oriented flutes.

14. A pump assembly comprising:

a motor including an output shaft:

a housing mounted on said motor and receiving said shaft therein; said housing including a rear end wall adjacent said motor and an open opposite front end;

a cylindrical member disposed within said housing and including an inner circumferential wall, an open front end including a circumferential rim and an open opposite rear end including a circumferential rim, a first closure member overlying said front end of said cylindrical member, a second closure member overlying said rear end of said cylindrical member, said cylindrical member and said second closure member being integrally formed;

a cylindrical hub having an outer circumference disposed within said cylindrical member and eccentrically mounted on said output shaft and rotatable therewith;

a plurality of vanes disposed about said outer circumference of said hub, said vanes being radially displaceable with respect to said cylindrical hub and in a direction toward said inner circumferential wall of said cylindrical member upon rotation of said cylindrical hub whereby ambient fluid is drawn into said cylindrical member, compressed and exhausted from said cylindrical member;

a cap member covering said front end of said housing and capturing said cylindrical member within said housing, said cap member and said first closure member including first respective openings therethrough for enabling the flow of ambient fluid into said cylindrical member and second respective openings therethrough for enabling the flow of compressed fluid from said cylindrical member to a location outside said cap member; and a Belleville washer disposed between said rear end wall of said housing and said second closure member overlying said rear end of said cylindrical member and providing a biasing force which urges said second closure member into a selective sealing relationship of said second closure member with said circumferential rim of said rear end of said cylindrical member and through said cylindrical member to said cap member to establish a selective sealing relationship between said circumferential rim of said front end of said cylindrical member and said cap member, said selective sealing relationship between each said first and said second closure member and said cylindrical member being a function of said biasing force asserted by said Belleville washer.

15. A pump assembly comprising:

a motor including an output shaft:

a housing mounted on said motor and receiving said shaft therein; said housing including a rear end wall adjacent said motor and an open opposite front end;

a cylindrical member disposed within said housing and including an inner circumferential wall, an open front end including a circumferential rim and an open opposite rear end including a circumferential rim, a first closure member overlying said front end of said cylindrical member, a second closure member overlying said rear end of said cylindrical member, said cylindrical member and said second closure member being integrally formed;

a cylindrical hub having an outer circumference disposed within said cylindrical member and eccentrically mounted on said output shaft and rotatable therewith;

a plurality of vanes disposed about said outer circumference of said hub, said vanes being radially displaceable with respect to said cylindrical hub and in a direction toward said inner circumferential wall of said cylindrical member upon rotation of said cylindrical hub whereby ambient fluid is drawn into said cylindrical member, compressed and exhausted from said cylindrical member;

a cap member covering said front end of said housing and capturing said cylindrical member within said housing, said cap member and said first closure member including first respective openings therethrough for enabling the flow of ambient fluid into said cylindrical member and second respective openings therethrough for enabling the flow of compressed fluid from said cylindrical member to a location outside said cap member; and a fluted washer disposed between said rear end wall of said housing and said second closure member overlying said rear end of said cylindrical member and providing a biasing force which urges said second closure member into selective a sealing relationship of said second closure member with said circumferential rim of said rear end of said cylindrical member and through said cylindrical member to said cap member to establish a selective sealing relationship between said circumferential rim of said front end of said cylindrical member and said cap member, said fluted washer having a plurality of radially oriented flutes, said selective sealing relationship between each said first and said second closure member and said cylindrical member being a function of said biasing force asserted by said fluted washer.

16. In a pump assembly comprising a cylindrical member having at least one open end defining a circumferential rim and a planar member overlying said open end and in engagement with said rim and a vane-bearing hub rotatably mounted within the cylindrical member for pulling fluid into the cylindrical member, compressing the fluid and expelling the fluid at a pressure greater than the pressure of the fluid entering the cylindrical member, an improvement defining an improved vane pump, said improvement comprising:

a resilient means disposed within the pump assembly and urging the planar member into sealing engagement with the rim, wherein the degree of sealing established between the planar member and the rim is a function of the degree of force developed by said resilient means and is substantially equal to the force required to permit the pump to develop a preselected maximum pressure output therefrom without halting the rotation of the hub.

17. A method for establishing and maintaining constant fluid pressure in a fluid receptacle, the method comprising:

providing a vane pump having a motor including an output shaft, a housing mounted on said motor and receiving said shaft therein, said housing including an open rear end adjacent said motor and an open opposite front end, a cylindrical member disposed within said housing and including an inner circumferential wall, an open front end defining a circumferential rim and an open opposite rear end defining a circumferential rim, a first closure member overlying said front end of said cylindrical member, a second closure member overlying said rear end of said cylindrical member, said cylindrical member and said second closure member being integrally formed, a cylindrical hub having an outer circumference disposed within said cylindrical member and eccentrically mounted on said shaft and rotatable therewith, a plurality of vanes disposed about said outer circumference of said cylindrical hub, said vanes being radially displaceable with respect to said cylindrical hub and in a direction toward said inner circumferential wall of said cylindrical member upon rotation of said cylindrical hub, a cap member covering said front end of said housing and capturing said cylindrical member within said housing, said cap member and said first closure member including first respective openings therethrough for enabling the flow of fluid into said cylindrical member and second respective openings therethrough for enabling the flow of fluid from said cylindrical member;

positioning a resilient means between said rear end of said housing and said second closure member overlying said rear end of said cylindrical member to provide a biasing force which urges said second closure member into a selective sealing relationship of said second closure member with said circumferential rim of said rear end of said cylindrical member, said resilient means being interchangeable to enable variation in the amount of said biasing force provided and fluid pressure maintained in the fluid receptacle by said pump, said selective sealing relationship between each said first and said second closure member and said cylindrical member being a function of said biasing force asserted by said resilient means; and actuating said vane pump to create a rotational force which is imparted to said output shaft and translated to said cylindrical hub to produce a centrifugal force that radially displaces said plurality of vanes within said cylindrical member, said eccentric disposition of said cylindrical hub on said output shaft enabling radial displacement of said plurality of vanes on said hub to create a variable pressure gradient whereby ambient fluid is drawn into said cylindrical member through said first respective openings, compressed and exhausted through said second respective openings into the fluid receptacle, said resilient means flexibly accommodating for excesses in fluid pressure above a preselected maximum pressure within the fluid receptacle and in heat generated through operation of said vane pump.

18. The method of claim 17 wherein said rear end of said housing defines a rear end wall and said resilient means is disposed between said rear end wall and said second closure member overlying said rear end of said cylindrical member.

19. The method of claim 18 wherein said biasing force is further transmitted through said cylindrical member to said cap member to establish a selective sealing relationship between said circumferential rim of said front end of said cylindrical member and said cap member, said selective sealing relationship being a function of the biasing force asserted by said resilient means.

20. The method of claim 18 wherein said resilient means is a Belleville washer.

21. The method of claim 18 wherein said resilient means is a washer having a plurality of radially oriented flutes.

* * * * *